US008277331B2

(12) United States Patent
Whitt et al.

(10) Patent No.: US 8,277,331 B2
(45) Date of Patent: Oct. 2, 2012

(54) GOLF TRAINING METHOD AND APPARATUS

(76) Inventors: Ricky Whitt, Palm Beach Gardens, FL (US); Peter Alevizos, Jupiter, FL (US)

( * ) Notice: Subject to any disclaimer, the term of this patent is extended or adjusted under 35 U.S.C. 154(b) by 135 days.

(21) Appl. No.: 12/946,389

(22) Filed: Nov. 15, 2010

(65) Prior Publication Data

US 2012/0122602 A1 May 17, 2012

(51) Int. Cl.
*A63B 69/36* (2006.01)

(52) U.S. Cl. ..... 473/274; 473/409; 473/266; 473/277

(58) Field of Classification Search ..... 473/274, 473/207, 208, 215, 266, 277, 409
See application file for complete search history.

(56) References Cited

U.S. PATENT DOCUMENTS

| | | | | |
|---|---|---|---|---|
| 1,561,960 | A | 11/1925 | Ungar | |
| 2,252,831 | A * | 8/1941 | Botts | 473/274 |
| 3,408,078 | A * | 10/1968 | Falerni et al. | 473/208 |
| 3,443,811 | A * | 5/1969 | Brooks | 473/274 |
| 3,510,135 | A * | 5/1970 | Gentile | 473/270 |
| 3,614,108 | A | 10/1971 | Garten | |
| 3,697,065 | A * | 10/1972 | Glassburner, Jr. | 482/14 |
| 3,740,051 | A * | 6/1973 | Cross | 473/268 |
| 3,926,430 | A | 12/1975 | Good, Jr. | |
| 4,583,738 | A * | 4/1986 | Fava | 473/263 |
| 5,050,874 | A | 9/1991 | Fitch | |
| 5,125,663 | A | 6/1992 | Lurowist, Jr. | |
| 5,334,028 | A * | 8/1994 | Melligan | 434/252 |
| 5,591,090 | A | 1/1997 | Kauffman, Jr. | |
| 5,651,680 | A | 7/1997 | Levy | |
| 5,672,115 | A | 9/1997 | Sanchez et al. | |
| 5,688,212 | A | 11/1997 | Walker | |
| 6,551,196 | B1 | 4/2003 | Kossnar et al. | |
| 6,719,640 | B1 * | 4/2004 | Madole | 473/215 |
| 6,843,730 | B1 | 1/2005 | Bellagamba | |
| 7,238,117 | B1 * | 7/2007 | Doss | 473/266 |
| 7,285,056 | B1 | 10/2007 | Whitt et al. | |
| 7,455,596 | B1 * | 11/2008 | Greene | 473/257 |
| 7,572,192 | B1 * | 8/2009 | Boyd | 473/274 |
| 7,645,198 | B2 | 1/2010 | Van Heerden | |
| 7,758,443 | B1 * | 7/2010 | Ford | 473/266 |
| 8,152,650 | B1 * | 4/2012 | Brandt | 473/266 |
| 2011/0086721 | A1 * | 4/2011 | Groves | 473/266 |
| 2011/0111877 | A1 * | 5/2011 | McManaman | 473/274 |

* cited by examiner

*Primary Examiner* — Raleigh W. Chiu
(74) *Attorney, Agent, or Firm* — McHale & Slavin, P.A.

(57) ABSTRACT

The disclosure sets forth an apparatus and method for use in training a golf player in the proper stance for swinging in full rotation, as well as for teaching direction putting skills. Specifically, the invention focuses upon training a golf player to assume a correct stance and posture from the point of addressing the ball through the swing and follow-through by employing a positioning item for a golf player's lower posterior, back, and head.

20 Claims, 8 Drawing Sheets

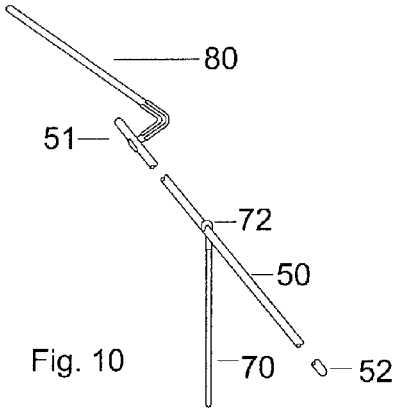
Fig. 10
Fig. 9
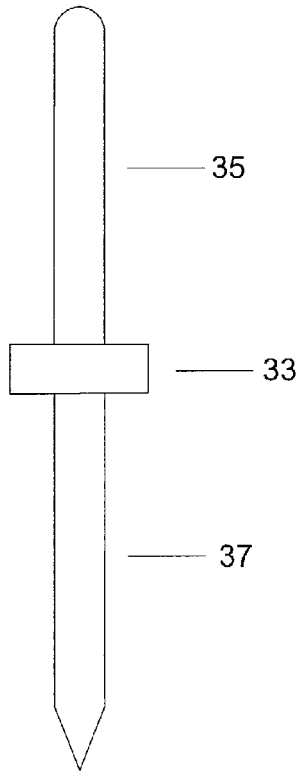

GOLF TRAINING METHOD AND APPARATUS

FIELD OF THE INVENTION

This invention is directed to the field of golf and, in particular, to a training apparatus and method to improve an individual's golf swing.

BACKGROUND OF THE INVENTION

The game of golf is an immensely popular sporting activity played throughout the world. The premise of the game requires ball control for purposes of completing a course in as few strokes as possible. Technological advancements allow amateurs to drive a golf ball distances that match the professionals; however, unless an individual has developed the proper swing, the possibility of competitive scoring will be elusive. Even if an individual has a good round of golf, repeatability is not probable unless the individual has a proper posture for both a full swing and a putting swing allowing predictability and repeatability.

A proper golf swing will reward a player with an enhanced enjoyment of the game, providing greater accuracy and golf ball driving distance. Many known devices concentrate on enhancing the golf swing for distance or accuracy and entrust the golf player to acquire the proper posture to meet the golf swing. However, it is proposed that golf training begins with understanding the proper posture and the effective golf swing will follow. Known training devices typically include restrictive controls over the body movement. Since the golf swing is an individually varying movement, a proper posture provides the basis for further training. Once proper posture is obtained, a golf player can then develop swing muscle memory leading to consistent play and a lower golf score.

While golf instructors are aware of the need for proper posture, it is not possible for an instructor to stand next to the golf player during the golf player's swing. However, any movement of the body can quickly result in a bad technique that may continue to haunt the golf player. Unfortunately, the average golf player typically fails to understand the body movement and cannot afford to take lessons from a professional. The improperly trained golf player may figure out the importance of good posture, but more typically ends up with a posture that inhibits improvement of their game.

A fluid swing motion involves the back swing, down swing, impact, follow-through and finish. Without the proper posture the golf player will develop a hook or slice due to the unstable addressing of the ball and the swing, leading to loss of accuracy, poor distance, and most importantly, possible early back problems.

U.S. Pat. No. 7,285,056, the contents of which are incorporated herein by reference, is the Applicant's previous invention and discloses a stool-like structure that has a lower portion having a ground engaging end and a middle portion coupled to the lower portion in such a way as to be selectively positionable to a preselected angle with respect to the lower portion. The structure is used to train a player to swing a golf club, and specifically, to train a golf player to assume a correct stance and posture from the point of addressing the ball through the swing and follow-through. While the structure has proved to be very effective in one aspect of training, it fails to provide a means for positioning the golf player's back at a preferred angle.

U.S. Pat. No. 5,125,663 discloses a swing training apparatus having a base with a strut extending upwardly therefrom, a support seat is mounted on the strut and rotational coupling allows rotation of the support seat. In this regard, the reference specifically discloses that the rotational coupling rotates in proportion to rotation of the golf player's hips, and is directed toward promoting hip rotation about a nearly vertical axis while maintaining a fixed location of the golf player's groin during the golf swing.

Many prior art devices fail to include any type of posture training wherein the training devices only provide muscle memory to a defined bad posture position.

U.S. Pat. No. 5,651,680 discloses a swing training device for conditioning a golf player to keep their head down. This device employs a tethering cord having one end attached to a mouthpiece and a second end secured to the individual's clothing. The device is designed to teach the proper swinging of a club, wherein detachment of the cord from the individual's clothing indicates improper swing movement.

U.S. Pat. No. 5,672,115 discloses a swing training device. A tee is mounted on a tee platform; a taut movable cord is then attached to the hip of a golf player standing on the platform which is further attached to a sensing unit. The sensing device provides an audio and visual response if the hips of the individual move beyond a predetermined position. The device sensing unit generates a forward, rearward and fore-strike position signal based upon optimum positioning.

U.S. Pat. No. 5,591,090 discloses a golf training device having a platform with a leg stand. The leg stand is adjustable and provides a rest between the knee and mid-thigh to avoid swaying during a golf swing. The stand does not allow for flexing of the waist which is necessary during a golf swing.

U.S. Pat. No. 7,645,198 discloses a golf swing training device configured to prevent lateral movement of a golf player's hips such as during the backswing, downswing and/or follow-through portions of the golf player's swing. The training device may comprise a seat assembly and a horizontal arm assembly. The seat assembly is configured to be mounted to the golf player's hips and defines opposing lateral seat sides. The horizontal arm assembly is coupled to the seat assembly and is configured to be pivotable about a seat pivot axis located adjacent one of the seat sides. The horizontal arm assembly is configured to prevent reverse pivoting of the seat assembly, such that reverse rotation of the golf player's hips is prevented.

U.S. Pat. No. 5,050,874 discloses a swing training device where a golf player executes a simulated golf swing by rotating a parabolic-shaped arm against a spring-loaded resistance mechanism which offers minimum resistance when the swing motion is in the proper plane.

U.S. Pat. No. 3,614,108 discloses a swing training device based upon a simulated golf club handle pivotally attached to an arm rotatably connected to a wall-mounted plate having adjustable inclination and adjustable frictional resistance.

U.S. Pat. No. 3,926,430 discloses a swing training device for exercising the principal sets of muscles used to play golf against a resistance force, while moving the muscles to simulate the manner in which they are moved during an actual golf swing. A user manipulates a handle connected to a rotatable shaft extending axially from a hydraulic chamber which generates a progressively and smoothly increasing resistance torque as the rotational speed of the shaft increases.

U.S. Pat. No. 6,551,196 discloses a swing training system having a pelvic belt which wraps around the golf player's hips. The belt is pivotally connected at one end to a base which is mounted on a supporting surface. The belt guides the golf player's hip rotation during the backswing, downswing, and follow through.

U.S. Pat. No. 6,843,730 discloses a swing training device having a frame with a base and an upright frame portion. The apparatus includes a back support attached to the upright frame apparatus and includes a Velcro fastener portion. The apparatus further includes a belt attachment to the individual golf player having a fastener portion which is aligned for coupling to the back support fastener portion. The training apparatus is specifically adapted to maintain the golf player's head, feet, legs and rear side to provide proper stance in developing a proper golf swing.

U.S. Pat. No. 5,688,212 discloses a swing training device which is mountable on a supporting surface, such as the ground, and which includes a vertical support having middle and lower rotational assistance assemblies. Each of the assemblies is vertically adjustable in alignment with the golf player's pectoral (i.e., chest) and hip levels.

U.S. Pat. No. 1,561,960 discloses a golf positioning apparatus having a base plate with a pole or standard extending upwardly therefrom. An abutment is pivotally mounted on the pole and is adapted to limit certain movements of the golf player's body during a golf swing. More specifically, the reference restricts movement of the golf player's body to a vertical pivotal axis.

In view of the limitations of the above-cited devices, there is a need for a device and technique whereby a golf player is trained in proper posture positioning thereby maintaining a golf player in a position to practice a swing pattern allowing rotation and other movements without interference.

SUMMARY OF THE INVENTION

Disclosed is an apparatus and method that is best used to train a player to swing a golf club, and specifically, how to assume a correct stance and posture from the point of addressing the golf ball through the golf swing including a proper follow-through stance.

The method of training a golf player to swing a golf club is based upon a housing formed from a rigid structure having a top, a bottom and a continuous side wall. The side wall includes at least one angular positioned aperture extending through the housing. The housing is placed on the ground and an alignment stick, having a first end and a second end defining a length therebetween, is constructed and arranged for slidable insertion into one of the angular positioned apertures with the first end inserted into the ground at a distance sufficient to provide anchoring of the housing. The second end of the alignment stick is now positioned in accordance with the angular disposition of the aperture and used to assure that the golf player is positioned properly. In an alternative embodiment, the housing may include an independent anchor; the independent anchor consisting of a length of rod having an upper end that is secured to a vertical aperture located on the bottom of the housing, and a lower end that is inserted into the ground.

When the alignment stick is placed in the horizontal aperture, the alignment stick is not inserted into the ground which allows use on a putting green. The alignment stick is then inserted into the horizontal aperture a distance so as to provide balancing of the housing without the need of anchoring. When the apparatus is used on a putting green, the full swing is replaced by a partial swing designed for accuracy rather than distance. In this use the alignment stick is inserted through a 0° angular positioned aperture wherein approximately 24 inches of the alignment stick extends outward from the apparatus and the remaining 24 inches does not pass through the aperture. The putting swing is then taken only as a partial swing and is directional for accuracy versus distance. In this manner, the golf player would stand directly over the alignment stick with the golf ball directly beneath the alignment stick. The putting can be practiced until the golf ball is found to continue under the path formed by the alignment stick.

The housing is used in positioning of the alignment stick at various angles and preferably has five prealigned apertures, namely 51°, 49°, 47° and 45°. Further, or alternatively, an angular slot is provided to allow a range of adjustments between 40° and 55°. The fixed apertures allow for insertion of the alignment stick which can pass through the apparatus and anchor into the ground at a predetermined angle. The angular slot is positioned in such a way as to allow the alignment stick to be selectively positionable to any angle with respect to the stance of the golf player. The preferred alignment stick is about 48 inches long.

For ease of storage, the housing includes a vertically disposed and tapered receptacle for receipt of an alignment stick when not in use. This is the same receptacle that accepts the anchoring rod should the housing require additional anchoring over the alignment stick. For instance, the alignment stick may be placed within a conventional golf bag and the housing placed on the end of the alignment stick. The housing protects the golf player from impacting an exposed end of the alignment stick. Further, the configuration can be made to assimilate a covered golf club so it will not distract from the visual aspect of the stored clubs.

The inventive method of training a player to swing a golf club is designed to cause a golf player to assume the right stance and posture from the point of addressing the ball through the follow-through of the golf swing. The inventive method includes the step of providing a housing having an alignment aperture for receipt of the alignment stick. When used in a full golf swing, the apparatus is placed on the ground and the alignment stick is drawn through one of the angular apertures and anchored into the ground. The end of the alignment stick is easily inserted into the ground when a narrow diameter stick is employed.

From address to follow-through, the upper end of the alignment stick should remain in contact with the player. The upper member is selectively positionable at a chosen angle with respect to the golf player's stance and overall height.

Thus, an objective of the invention is to provide an alignment device for use in monitoring a golf swing.

Another objective of the invention is to provide an alignment device that can be set at predetermined angles for use in monitoring a golf swing.

Yet still another objective of the invention is to provide an alignment device that utilizes the ground as an anchoring point so as to reduce the size and weight of the alignment housing.

Still another objective of the invention is to provide an alignment housing that also captures a pointed end of an alignment stick for safety when stored in a golf bag.

Yet another objective of the invention is to provide an alignment device that can be set at predetermined angles and remains in contact with the player through the swing.

Another objective of the invention is to provide an alignment device that can also be used for putting training wherein the alignment stick is positioned above the putting line.

Other objectives, advantages and novel features of the invention will become apparent from the following detailed description of the invention when considered in conjunction with the accompanying drawings.

BRIEF DESCRIPTION OF THE DRAWINGS

FIG. 9 is a side view of detachable base; and

FIG. 10 depicts placement of an upper and lower positioning stick; and

DETAILED DESCRIPTION OF THE PREFERRED EMBODIMENTS

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 2:
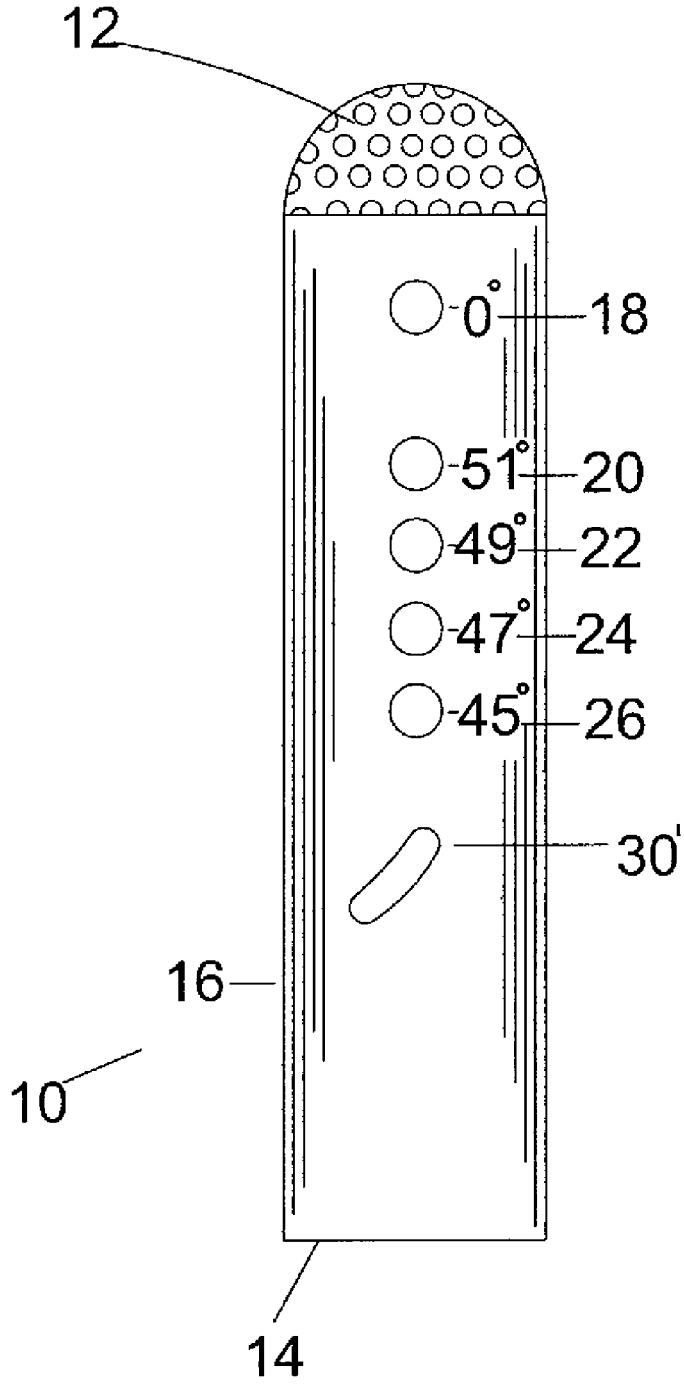
FIG. 2 is a front view of the instant invention.

The alignment device consists of a rigid housing 10 having a top 12, a bottom surface 14, and a side wall 16. The preferred embodiment employs a continuous side wall 16 in the form of a cylindrical shape. However, it is noted that the shape may be square, rectangular, octagon and so forth, wherein angular apertures may be placed a distance above the ground. Further, the housing may be contoured to provide an aesthetically pleasing shape including the formation of the top to resemble a golf ball with dimples and the bottom surface 14 can be pointed to resemble a tee. It remains the primary objective of the invention to provide an alignment device that operates by positioning of an alignment stick 50. The housing is constructed from any rigid material such as plastic or aluminum, and includes a plurality of angular positioned apertures for purposes of securing an alignment stick there through. As shown in FIG. 2, a horizontal angular aperture 18 extends through the housing and is used for positioning of an alignment stick in a position parallel to the bottom surface 14. As will be explained later in this description, placement of an alignment stick in aperture 18 provides an alignment guide for use in putting, wherein the alignment stick is positioned above a putter head about 6 inches above the ground. In this embodiment an individual may stand over the alignment stick to provide instant feedback of the direction, also shown in FIG. 9.

Figure 3:
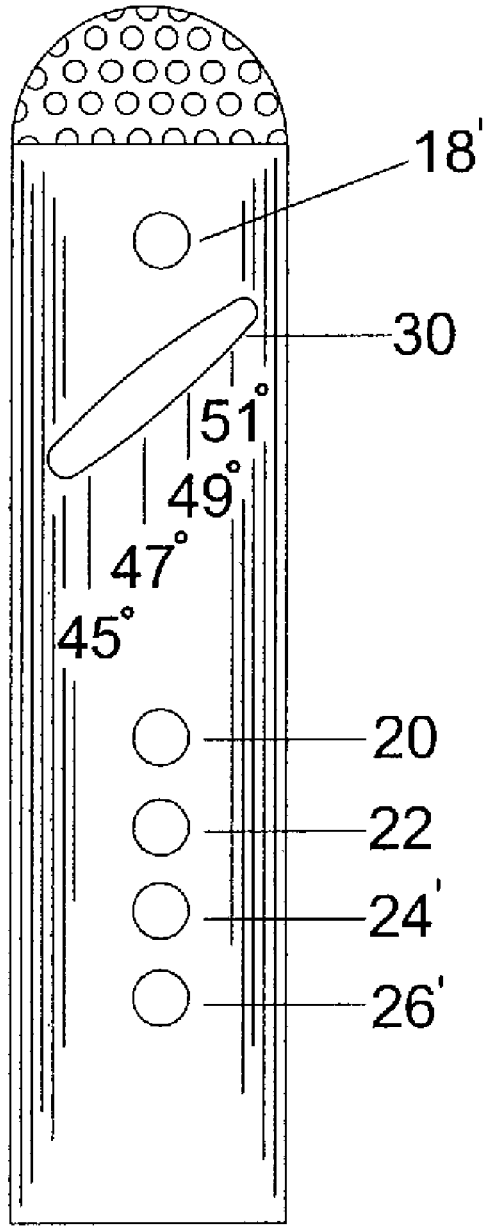
FIG. 3 is a back view of FIG. 2.

Angular alignment aperture 20 is placed at a 51° angle, aperture 22 is placed at a 49° angle, aperture 24 is placed at a 47° angle, and aperture 26 is placed at a 45° angle. The entrance of the apertures is illustrated on FIG. 2 with the exit of the aperture shown in FIG. 3 depicted by numerals 20', 22', 24' and 26' respectfully. The preferred size of the alignment stick is from about ¼ inch in diameter to about 3/16 inch in diameter, with a length of between 40 and 70 inches. It should be noted that in place of individual apertures, or in addition thereto, a slotted through hole numeral 30 can be employed wherein the alignment stick can be placed through the opening to slot 30 and extend through the housing to the rear opening 30'. By positioning of the alignment stick at a particular angle, the stick can be positioned between 40° and 55° with markings set at 45°, 47°, 49°, and 51° by rotating of the housing while the alignment stick is held in position.

The alignment stick 50 is preferably made from plastic, fiberglass, carbon fiber, aluminum or a like lightweight material. The shape can be round, oval, square or any other shape that is sized and insertable through one of the angular apertures. In operation, the end 52 of the alignment stick 50 is inserted into the ground 100 a sufficient distance so as to provide anchoring of the alignment stick in relation to the housing 10. In this manner the housing 10 can be made of most any material and most any shape for the stability is obtained by inserted the anchoring end 52 into the ground where the alignment stick is held in position by the housing and maintained at the preferred angle for instructional purposes. Although not used in this example, the alignment stick 50 could also be placed through the alignment slot 30 and extend through the outlet of the slot 30' again with the end of the alignment stick placed into the ground for anchoring purposes. In addition, a base 33 can be used in difficult anchoring areas, wherein mounting tab 35 is inserted into the bottom 50 aperture 60 and anchor tab 37 is inserted into the ground.

Figure 4:
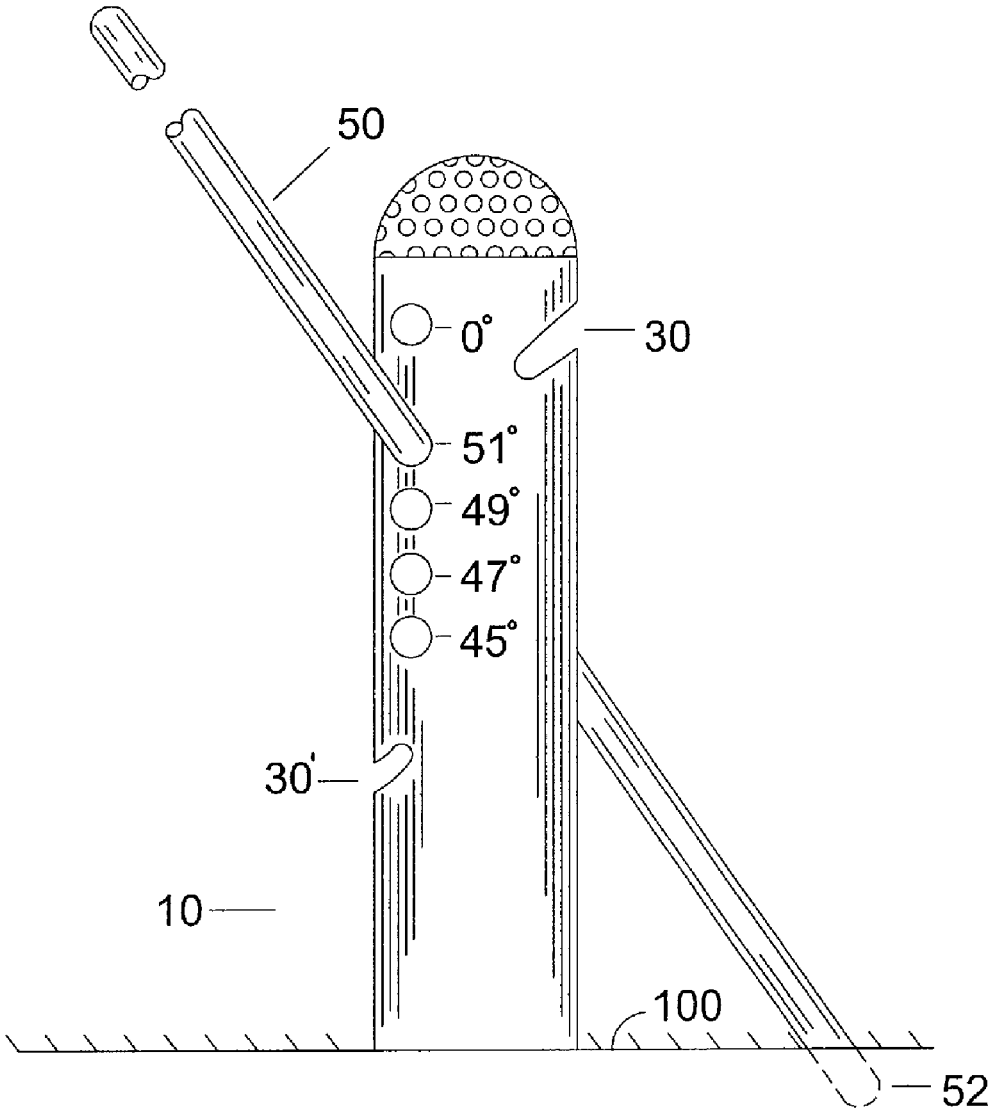
FIG. 4 is a side view with an alignment stick inserted into a 51° aperture.
Figure 5:
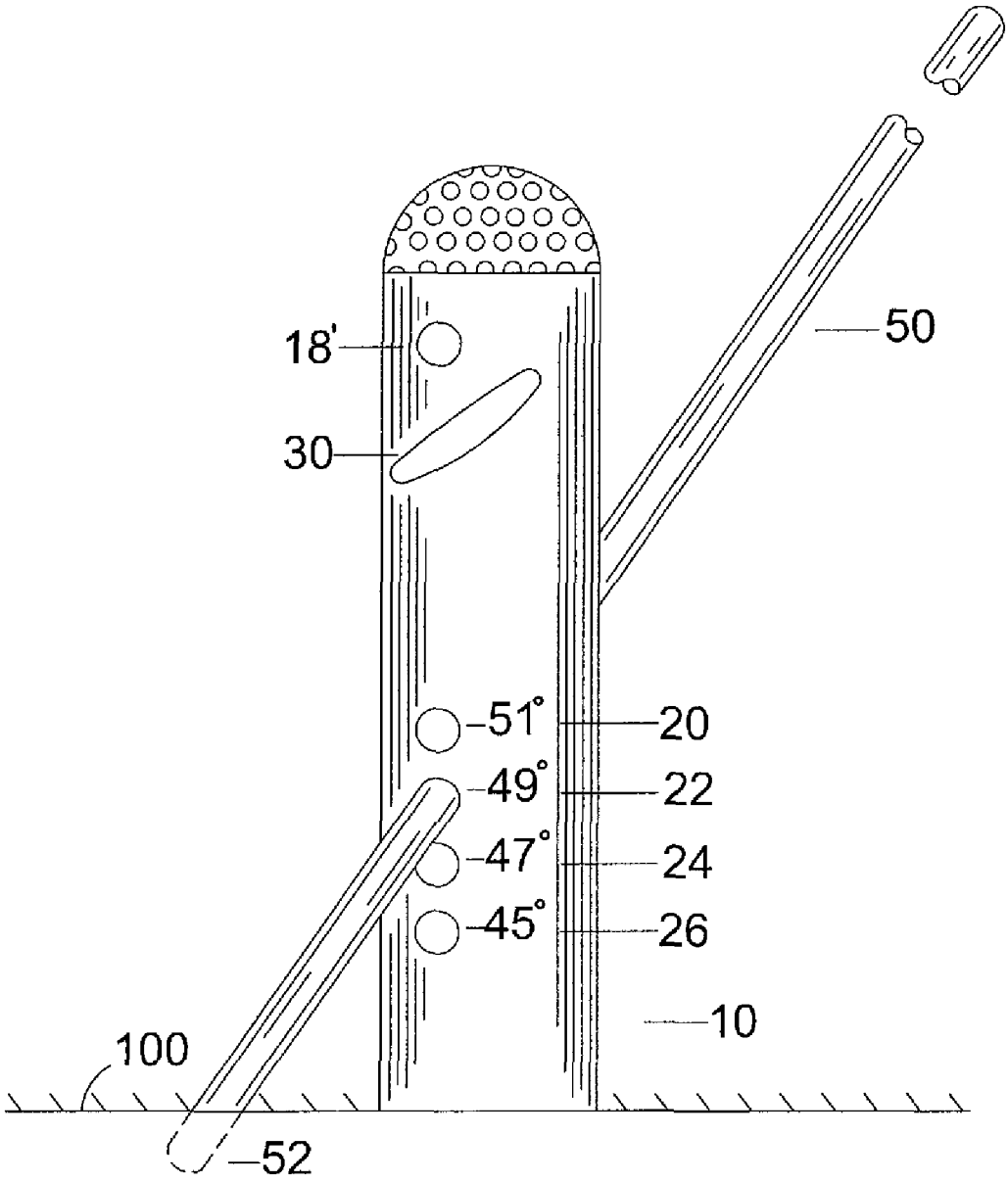
FIG. 5 is an opposite view with an alignment stick inserted into a 49° aperture.
Figure 6:
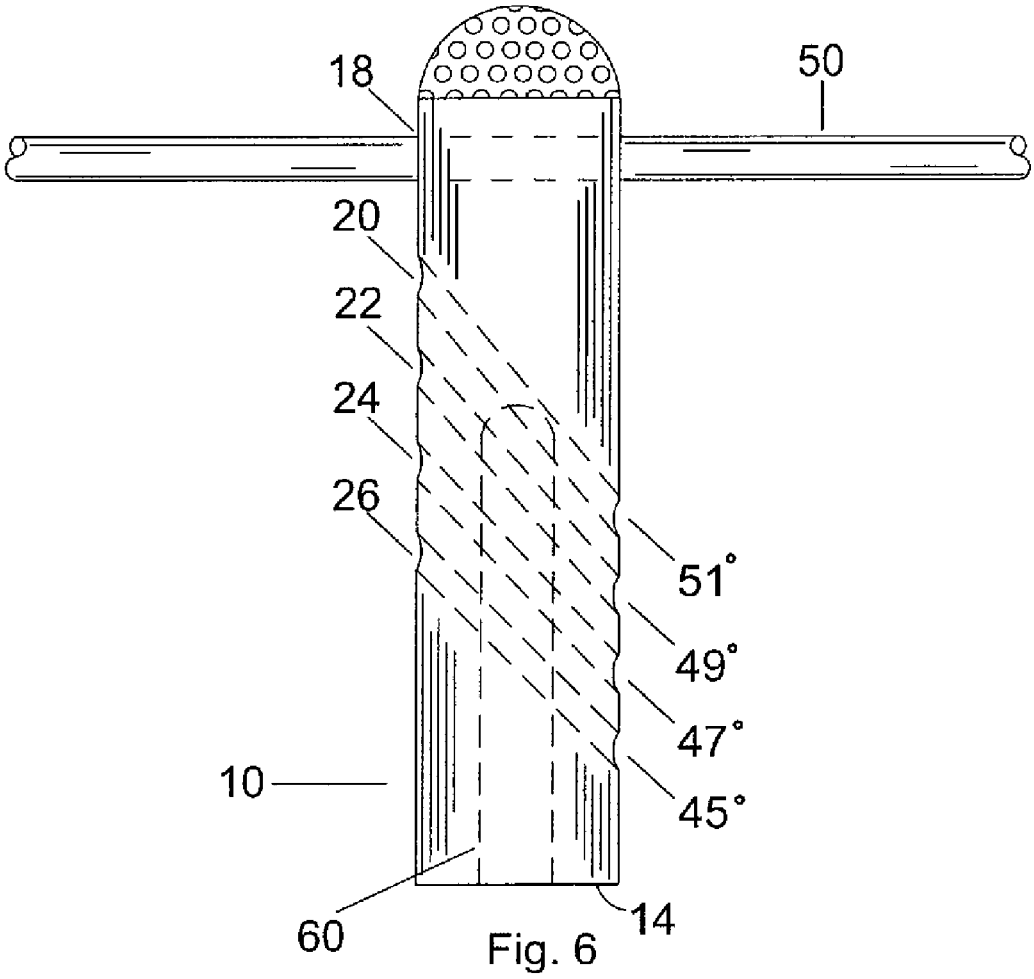
FIG. 6 is a side view with an alignment stick inserted into a 0° aperture of the alignment housing with hidden lines depicting the remaining angular apertures.

Referring now to FIG. 4-6, shown is the housing 10 with through angular apertures 20, 22, 24, and 26, and for illustration purposes, the alignment stick 50 is shown inserted through the housing 10 at the 51° angle and the end 52 of the alignment stick 50 anchored into the ground 100 which maintains the positioning of the housing 10. FIG. 5 depicts the alignment stick 50 extending through the 49° aperture. These examples do not use aperture 30 or the putting hole defined by the zero degree aperture 18. It should be noted that aperture holes 20-26 can be of any configuration including a singular opening on a front surface of the housing with multiple holes in the rear surface. Alternatively, a single hole may be placed in the rear surface of the housing with multiple alignment holes in the front surface. The purpose of the invention is to provide an alignment device in combination with an alignment stick that incorporates the ground and an alignment device for anchoring purposes.

Referring now to FIG. 6, shown is the housing 10 with the alignment stick 50 placed into angular aperture 18 having a 0° angle which is parallel to bottom surface 14. It should be noted that for balance purposes the alignment stick is placed through the aperture wherein half of the alignment stick extends out one side of the housing 10 and the other half protrudes from the opposite side. This provides a balanced structure without the need of a ground anchor. This further allows for the placement of the device upon a putting green without breaching the surface. The preferred distance between the bottom surface 14 and angled aperture 18 is approximately 6 inches which will allow for a wide range of putting stances and for distance putts. In operation, the golf player can place the ball beneath the alignment stick 50 and stand over the alignment stick wherein a short swing, as used in putting, advances the golf ball beneath the length of the alignment stick. If the putting is performed correctly, the club slides along the length of the alignment stick, training that the directional placement of the golf ball is along a straight line. Should the golf player have an inside-out swing, the alignment stick would be struck and moved indicating an improper swing. The visual alignment of the golf ball beneath the alignment stick provides a positive reinforcement that the putter was swung properly. Further, as noted in FIG. 5, the apertures 20, 22, 24, and 26 are shown in their angular position, wherein passage of the alignment stick can be positioned in the preferred angular aperture as required for the golf instruction.

Figure 8:
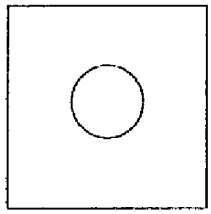
FIG. 8 is the side view of the alignment stick with accessories.
Figure 7:
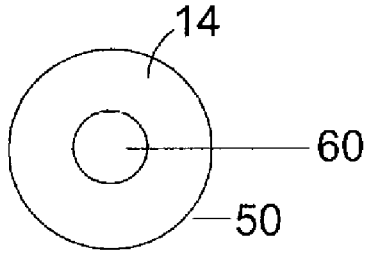
FIG. 7 is a bottom view thereof.

As will be discussed further in this specification, and shown in FIG. 6-8 a closed aperture 60 is provided for insertion of the end 52 of the alignment stick 50 when not in use. The housing 10 then operates as a protector to prevent accidental engagement with the pointed end of the alignment stick, as well as allow for ease of storage and retrieval of the housing when needed. Although a single alignment closed aperture 60 is shown, it should be noted that multiple apertures could be placed within the alignment device should multiple alignment sticks 50 be employed. In addition, the closed aperture 60 can be used for receipt of an anchoring stick shown in FIG. 9. The anchoring stick consists of a base 33 that can be used in difficult anchoring areas wherein mounting tab 35 is inserted into aperture 60 and anchor tab 37 is inserted into the ground. The anchoring stick is not for use on a putting green, but rather in stances where the alignment stick may be bumped by the golf player, such as during a practice golf swing. The anchoring stick in combination with the end of the alignment stick provides superior anchoring capable of resisting movement and/or dislodgement.

Figure 1:
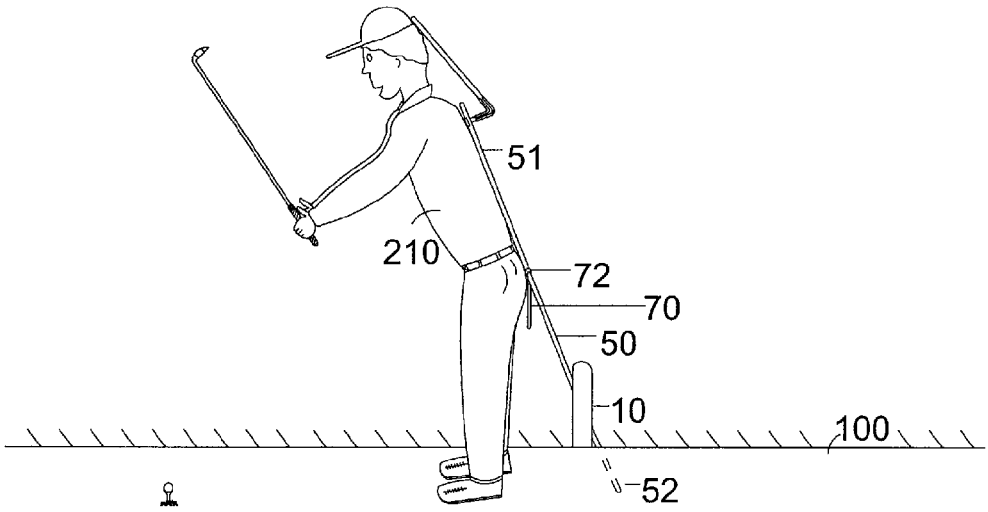
FIG. 1 is a pictorial view of a golf player utilizing the instant invention.

Referring to FIG. 10, the alignment stick 50 is illustrated in combination with a positioning stick 70 securable thereto. The positioning stick 70 includes a hook shaped top 72 which is constructed and arranged to engage the alignment stick and be slidably positioned along the length of the alignment stick for purposes of forming a backstop, as illustrated in FIG. 1, for the golf player. The alignment stick 50 may include markings or like indicia so that placement position is repeatable. In addition, a head positioning stick 80 can be attached to the alignment stick 50 for purposes of training a golf player to keep their head from rising up after a golf swing. The head positioning stick can be constructed of a memory retaining metal, wherein the stick is bent into position, or can be constructed of a rigid material with positioning accomplished by ratchet style couplings as shown and described in the original patent.

In operation, the housing 10 is placed upon the ground 100 with the alignment stick 50 placed through an appropriate aperture with end 52 of the alignment stick 50 inserted into the ground to anchor the housing 10 in position with the alignment stick 50 in the predetermined angular position. For stance placement, the positioning stick 70 is then hooked over the alignment stick 50 at the appropriate location. The golf player 210 illustrated in FIG. 1 is located next to position stick 70 and beneath the alignment stick 50. The upper end 51 of the alignment stick 50 is shown in a position wherein the golf player can feel the stick during the swing process, and should the golf player straighten their knees or otherwise lift their back they would immediately impact the alignment stick 50 and/or the positioning stick 70 so as to provide positive reinforcement for maintaining the proper posture throughout the entire swing. In addition, head positioning stick 80 is placed in a position so as to detect head movement and provide positive reinforcement to the golf player if they raise their head. In this manner the golf player may receive instructional lessons from a golf instructor and, once they understand the proper positioning that is correct for their posture based on size, length of clubs, and related factors, the golf player may then understand at what angular position the alignment stick should be placed and what position the positioning stick 70 should be placed in relation to the alignment stick 50. The continuing problem that a golf player has to address is the proper stance, wherein, a majority of the time, the golf player may practice their swing without the need for positioning sticks 70 and 80.

Figure 11:
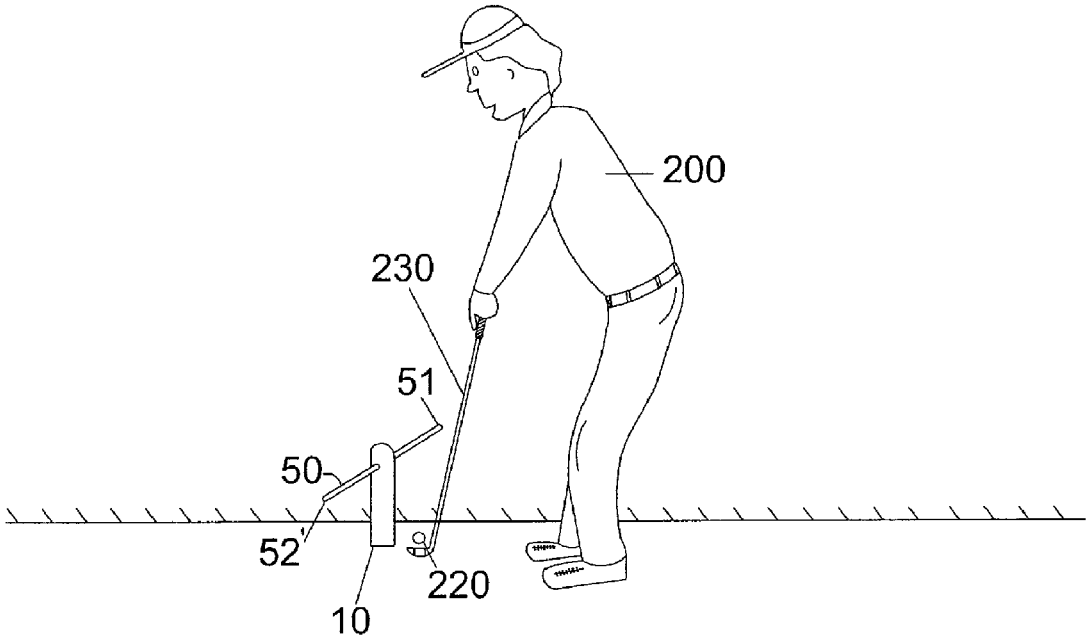
FIG. 11 is a pictorial view of a golf player employing the instant invention for stance and directional control while putting.

FIG. 11 depicts the housing 10 and the alignment stick 50 placed in the zero (0) degree putting position, wherein a first end 52 and a second end 51 of the alignment stick is positioned equally so as to be balanced on the housing 10. To practice a putting swing, the golf player 200 places a golf ball 220 on the ground and, in swinging the shaft of the putter 230, would brush against or otherwise slide along the alignment stick 50. Once the putter head strikes the golf ball 220, the golf player can visually watch the ball travel in relation to the alignment stick 50 providing a positive reinforcement as to whether the swing is repeatable and illustrates a straight line strike.

Storage of the alignment stick 50 and housing 10 is made most convenient and can be placed within a golf bag together with golf clubs. In this manner the alignment stick and housing can be carried at all times without concern of having an exposed rod edge impact a golf players hand while inserting or removing conventional golf clubs. This is particularly beneficial if the end 52 has been sharpened for ease of insertion into dry ground. The end of the housing may include an ornamental shape, such as the square shape depicted in FIG. 8, or in the likeness of a golf ball (not shown) or any other shape that may compliment the conventional golf clubs. The alignment stick may also be constructed from telescoping material to permit ease of storage within a golf bag pocket.

All patents and publications mentioned in this specification are indicative of the levels of those skilled in the art to which the invention pertains. All patents and publications are herein incorporated by reference to the same extent as if each individual publication was specifically and individually indicated to be incorporated by reference. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Various modifications of the described modes for carrying out the invention which are obvious to those skilled in the art are intended to be within the scope of the claims.

What is claimed is:

1. A method of training a golf player to swing a golf club comprising the steps of:

addressing a golf ball lying on the ground with the golf club in hand;

assuming a stance for a golf swing;

providing a housing having a top, a bottom and a side wall, said side wall having at least one angular positioned aperture extending therethrough;

positioning said housing wherein said bottom contacts the surface of the ground;

providing an alignment stick having a first end and a second end defining a length therebetween, said alignment stick constructed and arranged for slidable insertion through said aperture;

inserting said alignment stick into and through one of said angular positioned apertures wherein the second end of said alignment stick provides proper positioning for a golf player;

executing a golf swing wherein alignment stick remains in contact with the player through the swing.

2. The method of training a golf player to swing a golf club according to claim 1 wherein said first end of said housing is placed in a horizontally disposed aperture to position said alignment stick parallel to the ground to assist a golf player with putting.

3. The method of training a golf player to swing a golf club according to claim 2 wherein said horizontally disposed thru-hole is about six inches above the bottom surface of said structure.

4. The method of training a golf player to swing a golf club according to claim 2 wherein said first end of said alignment stick is ground engaging and a second end of said alignment stick to engage a back portion of the golf player.

5. The method of training a golf player to swing a golf club according to claim 4 including the step of inserting at least a portion of the ground-engaging end into the ground.

6. The method of training a golf player to swing a golf club according to claim 3 wherein said predetermined angle is between about 40° and 55°.

7. The method of training a golf player to swing a golf club according to claim 2 including a positioning stick securable to said alignment stick wherein a golf player positions their posterior against said positioning stick for purposes of stance repositioning.

8. The method of training a golf player to swing a golf club according to claim 7 wherein said positioning stick is slidable securable along the length of said alignment stick.

9. The method of training a golf player to swing a golf club according to claim 2 wherein said horizontally disposed thru-hole is parallel with the bottom surface of said structure.

10. The method of training a golf player to swing a golf club according to claim 1 including an anchoring stick positionable between the bottom of the housing and insertable into the ground a predetermined distance.

11. The method of training a golf player to swing a golf club according to claim 1 wherein said thru-hole is slotted to provide angular positioning of said alignment stick between about 40° and 55°.

12. The method of training a golf player to swing a golf club according to claim 1 wherein said alignment stick is about 48 inches long and about 3/16 inches in diameter.

13. A golf swing training device comprising:

a housing having a top, a bottom and a side wall, said side wall having at least one angular positioned aperture extending therethrough;

an alignment stick having a first end and a second end defining a length therebetween, said alignment stick constructed and arranged for slidable insertion through said aperture;

wherein inserting said alignment stick into and through said angular positioned aperture positions said alignment stick whereby a golf player executing a golf swing remains in contact with the second end of said alignment stick through the swing to assure a proper golf swing stance.

14. The golf swing training device according to claim 13 including a horizontally disposed aperture in said housing for positioning said alignment stick parallel to the ground to assist a golf player with putting.

15. The golf swing training device according to claim 13 including an anchoring stick having a first end inserted into a vertical aperture located in said bottom of said housing and a second end available for insertion into the ground predetermined distance.

16. The golf swing training device according to claim 13 wherein said angular positioned aperture is between about 40° and 55°.

17. The golf swing training device according to claim 13 wherein said angular positioned aperture is slotted.

18. The golf swing training device according to claim 13 including a lower positioning stick securable to said alignment stick wherein a golf player positions their posterior against said positioning stick for purposes of stance positioning.

19. The golf swing training device according to claim 13 including a head positioning stick securable to said alignment stick wherein a golf player positions their head against said positioning stick for purposes of stance positioning.

20. The golf swing training device according to claim 13 wherein said alignment stick is about 48 inches long and about 3/16 inches in diameter.

* * * * *